US008943612B2

(12) United States Patent
Jeong et al.

(10) Patent No.: US 8,943,612 B2
(45) Date of Patent: Feb. 3, 2015

(54) SANITARY FINGER CAP

(76) Inventors: Hyeon-Jin Jeong, Gyeonggi-do (KR); Jeong-Tae You, Gyeonggi-do (KR)

( * ) Notice: Subject to any disclaimer, the term of this patent is extended or adjusted under 35 U.S.C. 154(b) by 405 days.

(21) Appl. No.: 13/001,046

(22) PCT Filed: Jun. 12, 2009

(86) PCT No.: PCT/KR2009/003163
§ 371 (c)(1),
(2), (4) Date: Dec. 22, 2010

(87) PCT Pub. No.: WO2009/157663
PCT Pub. Date: Dec. 30, 2009

(65) Prior Publication Data

US 2011/0107499 A1 May 12, 2011

(30) Foreign Application Priority Data

Jun. 24, 2008 (KR) ..... 10-2008-0059436
Sep. 26, 2008 (KR) ..... 10-2008-0094523

(51) Int. Cl.
*A41D 19/015* (2006.01)
*A41D 19/00* (2006.01)

(52) U.S. Cl.
CPC ..... *A41D 19/0055* (2013.01)
USPC ..... 2/21; 2/163; 2/161.8

(58) Field of Classification Search
USPC ..... 2/158, 159, 160, 161.6, 161.7, 163, 2/167, 169, 16, 20, 21
See application file for complete search history.

(56) References Cited

U.S. PATENT DOCUMENTS

| | | | | | |
|---|---|---|---|---|---|
| 1,235,199 | A | * | 7/1917 | Gavin | 2/21 |
| 2,129,496 | A | * | 9/1938 | Hollingsworth | 2/21 |
| 2,717,799 | A | * | 9/1955 | Jones | 294/25 |
| 2,935,354 | A | * | 5/1960 | Chapman | 294/25 |
| 3,018,484 | A | * | 1/1962 | Koehn | 2/21 |
| 3,248,112 | A | * | 4/1966 | Metzger | 473/61 |
| 3,511,242 | A | * | 5/1970 | Agnone | 606/148 |
| 3,728,736 | A | * | 4/1973 | Pugh | 2/21 |
| 4,308,860 | A | * | 1/1982 | Sanders et al. | 601/137 |
| 4,733,410 | A | * | 3/1988 | Glotkin | 2/21 |
| 4,751,747 | A | * | 6/1988 | Banks et al. | 2/21 |
| 4,763,940 | A | * | 8/1988 | Held | 294/25 |
| 4,938,515 | A | * | 7/1990 | Fazio | 294/25 |

(Continued)

FOREIGN PATENT DOCUMENTS

| | | | | |
|---|---|---|---|---|
| KR | 20-1998-0006283 | * | 2/1998 | A41D 13/08 |
| KR | 20-1998-0006283 | | 4/1998 | |

OTHER PUBLICATIONS

International Search Report corresponding with International application No. PCT/KR2009/003163, dated Feb. 16, 2010.

(Continued)

*Primary Examiner* — Andrew W Collins
(74) *Attorney, Agent, or Firm* — Rabin & Berdo, P.C.

(57) ABSTRACT

A sanitary finger cap including: an insertion portion having a generally cylindrical shape and adapted to be fitted to a third knuckle of a finger connected to the center of a hand or to a portion of a second knuckle of the finger; and a grasping portion connected with one side of the insertion portion as a unitary body, in a shape of a general corn or pyramid in such a manner as to become small in thickness as it goes toward the other side thereof, and adapted to be fitted to a first knuckle as the end portion of the finger or to the second knuckle of the finger so as to grasp food thereon.

4 Claims, 6 Drawing Sheets

(56) References Cited

U.S. PATENT DOCUMENTS

| | | | | |
|---|---|---|---|---|
| 5,280,661 | A * | 1/1994 | Brown | 15/214 |
| 5,440,774 | A * | 8/1995 | Cole | 15/105 |
| D368,330 | S * | 3/1996 | Robinson | D29/119 |
| 5,749,097 | A * | 5/1998 | Garrett-Roe | 2/21 |
| 6,110,186 | A * | 8/2000 | Rizvi | 606/148 |
| 6,145,128 | A * | 11/2000 | Suzuki | 2/21 |
| 6,726,068 | B2 * | 4/2004 | Miller | 223/101 |
| 6,837,796 | B2 * | 1/2005 | Bernhardt | 473/61 |
| 6,839,905 | B1 * | 1/2005 | Bruder et al. | 2/21 |
| 6,951,032 | B1 * | 10/2005 | Rifkin | 2/21 |
| 6,990,985 | B1 * | 1/2006 | Allen et al. | 132/200 |
| 7,549,188 | B2 * | 6/2009 | McDevitt et al. | 15/227 |
| 7,552,501 | B2 * | 6/2009 | Yang et al. | 15/227 |
| 2002/0152538 | A1 * | 10/2002 | McDevitt et al. | 2/163 |
| 2003/0056274 | A1 * | 3/2003 | Sorrels | 2/21 |
| 2004/0045071 | A1 * | 3/2004 | Robins | 2/21 |
| 2005/0268369 | A1 * | 12/2005 | Santiago | 2/21 |
| 2006/0118129 | A1 * | 6/2006 | Allen et al. | 132/73 |
| 2006/0230487 | A1 * | 10/2006 | Salomon | 2/21 |
| 2007/0118947 | A1 * | 5/2007 | Lorenzo | 2/21 |
| 2008/0018123 | A1 * | 1/2008 | Cox | 294/25 |
| 2008/0066210 | A1 * | 3/2008 | Berry et al. | 2/21 |
| 2008/0109928 | A1 * | 5/2008 | Bae | 2/21 |
| 2008/0222764 | A1 * | 9/2008 | Gard | 2/21 |
| 2010/0037361 | A1 * | 2/2010 | Liu | 2/21 |

OTHER PUBLICATIONS

Abstract of KR 10-2006-0041419.

* cited by examiner

SANITARY FINGER CAP

BACKGROUND OF THE INVENTION

1. Field of the Invention

The present invention relates to a sanitary appliance for food, and more particularly, to a sanitary glove which is worn on a finger to simply grasp food without staining the finger.

2. Background of the Related Art

Generally, there are sanitary appliances for food such as chopsticks, forks, toothpicks and the like.

In fact, it is very hard to grasp food like fried chicken, pizza, hamburgers, fried food and so on by using the sanitary appliances like chopsticks or forks, and thus, such food is usually grasped by using fingers or at a state of being wrapped with napkins.

If the food is grasped by fingers or napkins, however, there occur some problems as follows:

Firstly, even though hands are washed well before grasping food, bacteria still remain on the hands, and when food is eaten outdoors, it is sometimes difficult to wash hands before eating, so that the food may be eaten in a very unsanitary state.

Secondly, chemical substances like fluorescent materials discharged from napkins or tissues may give bad influences on the human body.

Thirdly, if hot food is grasped by fingers, serious hurt may be applied to the skin of the fingers.

Lastly, it is hard to completely remove oil or seasonings remaining on the fingers after taking the food, so that unpleasant food odors may stay on the fingers.

So as to solve these problems, thus, there have been proposed a variety of sanitary appliances. As one example of the conventional practices, there has been disclosed a method for grasping food through a cap worn on a finger.

A conventional sanitary finger cap has an advantage in that since the cap is worn on a finger, food is grasped without staining the finger.

However, the conventional sanitary finger cap has the following problems:

Firstly, since the surface of the cap is slippery, it is difficult to stably grasp and hold food.

Secondly, the cap is made, taking no consideration of the lengths of the fingers of adults and children, the thicknesses of the fingers of males and females, the thicknesses of the fingers themselves, and the lengths and thicknesses of the fingers of individuals, such that the cap is easily stripped off during the use.

Thirdly, the surface of the cap is slippery, and thus, when hot food is grasped by the cap, the hot temperature of the food is transferred just to the skin of the fingers, thereby unfortunately causing burn on the skin of the fingers.

Lastly, if the thickness of the finger is almost the same as the sectional size of the cap, the possibility where the cap is stripped off becomes reduced, but while the cap is worn on the finger for a long time, the cap is wet inside by the sweat generated from the finger and is not easily stripped off.

SUMMARY OF THE INVENTION

Accordingly, the present invention has been made in view of the above-mentioned problems occurring in the prior art, and it is an object of the present invention to provide a sanitary finger cap that has an insertion portion and a grasping portion connected as a unitary body to each other in such a manner as to be worn on a wearer's finger, thereby grasping food sanitarily, while having no direct contact with the food.

It is another object of the present invention to provide a sanitary finger cap that has a plurality of protrusions formed on the underside of a grasping portion, thereby stably maintaining the state of grasping food, while preventing food from slipping on the grasping portion.

It is yet another object of the present invention to provide a sanitary finger cap that has a plurality of protrusions formed on the underside of a grasping portion, thereby preventing a hot temperature generated from hot food from being directly transferred to the skin of a hand when the hot food is grasped.

It is still another object of the present invention to provide a sanitary finger cap that has fixing grooves formed on the top surface of a grasping portion, thereby being brought into close contact with a top of a wearer's finger.

It is yet still another object of the present invention to provide a sanitary finger cap that has folding parts formed on a partial or entire surface of an insertion portion, thereby improving the feeling of wearing and enhancing a ventilation performance thereof.

It is yet another object of the present invention to provide a sanitary finger cap that has an insertion portion having an edge part formed along the end periphery thereof, thereby adjusting the length or thickness of the insertion portion.

It is still another object of the present invention to provide a sanitary finger cap that has a connection portion adapted to connect one side of an insertion portion of the sanitary finger cap with one side of an insertion portion of another sanitary finger cap, thereby improving the feeling of wearing and preventing the respective sanitary finger caps from being lost.

To accomplish the above objects, according to the present invention, there is provided a sanitary finger cap including: an insertion portion having a generally cylindrical shape and adapted to be fitted to a third knuckle of a finger connected to the center of a hand or to a portion of a second knuckle of the finger; and a grasping portion connected with one side of the insertion portion as a unitary body, in a shape of a general corn or pyramid in such a manner as to become small in thickness as it goes toward a distal end of the grasping portion, and adapted to be fitted to a first knuckle in an end portion of the finger or to the second knuckle of the finger so as to grasp food thereon.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on a sanitary finger cap according to preferred embodiments of the present invention will be in detail given with reference to the attached drawings.

According to the preferred embodiments of the present invention, a sanitary finger cap largely includes an insertion portion and a grasping portion.

Figure 1:
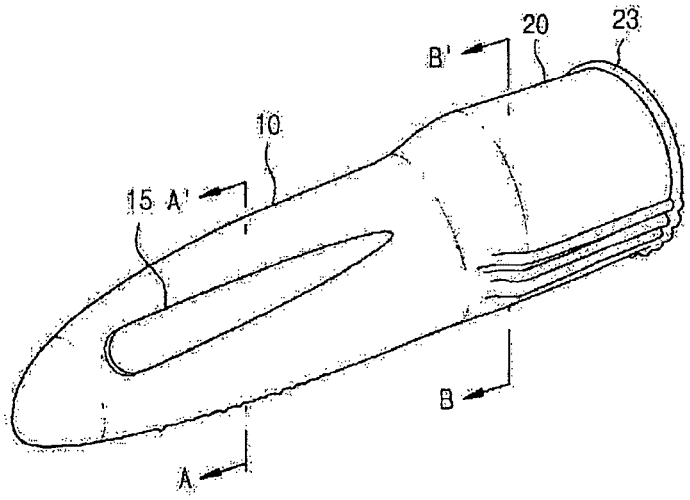
FIG. 1 is a perspective view showing a sanitary finger cap according to a first embodiment of the present invention.
Figure 2:
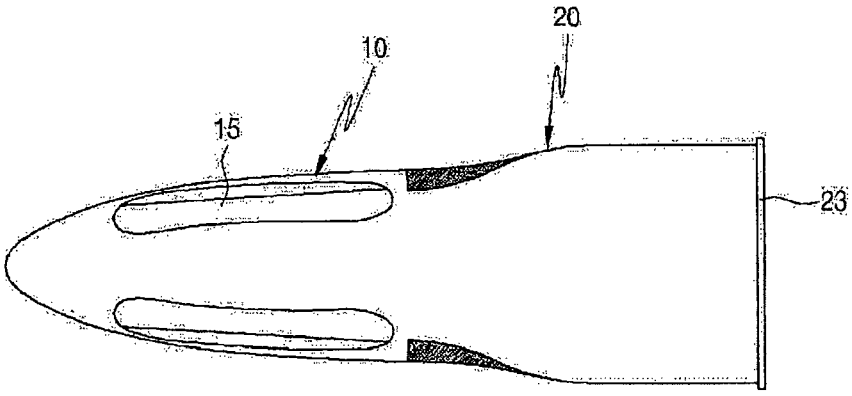
FIG. 2 is a plan view showing the sanitary finger cap according to the first embodiment of the present invention.

FIG. 1 is a perspective view showing a sanitary finger cap according to a first embodiment of the present invention, wherein the sanitary finger cap largely includes an insertion portion 20 and a grasping portion 10 and is formed of natural rubber, plastic synthetic material, or paper, which is thin, flexible, strong in heat, and harmless to the human body.

For example, the insertion portion 20 and the grasping portion 10 are formed of natural latex or low-density polyethylene (LDPE).

The natural latex is made of a fluid extruded from the bark of a natural rubber tree cultivated around the Malay Peninsula, which is a natural material that has excellent elasticity and restoring force and an antimicrobial activity.

The low-density polyethylene is polyethylene made at a high pressure, that is, polyethylene made in a high pressure process wherein waste gas at a gas station or ethylene gas is polymerized at a high pressure.

The low-density polyethylene has a melting point of 107° C. to 112° C., a density of 0.92, high transparency, and soft touch, and is widely used for film or sheet.

Preferably, the insertion portion 20 and the grasping portion 10 have a thickness of about 0.2 mm to 0.4 mm.

The insertion portion 20 is a portion into which a finger is first inserted and has a shape of a general cylinder corresponding to the shape of the finger.

When the insertion portion 20 is worn on a finger, also, it has such a peripheral size as to accommodate the thickest portion of the finger therein, that is, a third knuckle of the finger connected to the center of a hand or a portion of a second knuckle of the finger.

In other words, since the second knuckle of the finger has a smaller thickness than the third knuckle of the finger, preferably, the insertion portion 20 is reduced in the peripheral size thereof as it goes from one side thereof to the other side thereof.

Figure 3:
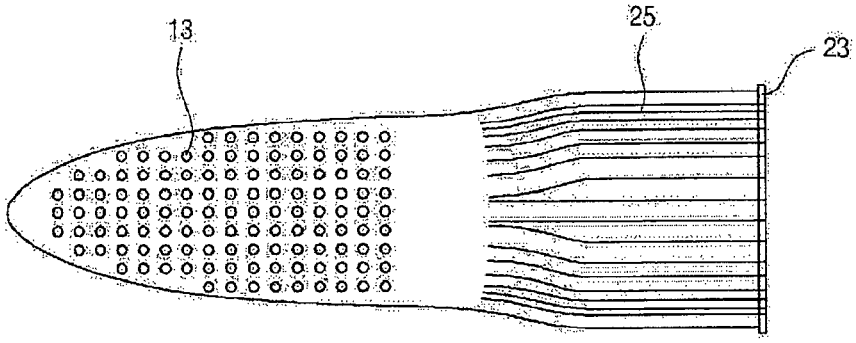
FIG. 3 is a bottom view showing the sanitary finger cap according to the first embodiment of the present invention.

As shown in FIG. 3, further, the insertion portion 20 has at least one or more folding parts 25 formed on one side or entire surface of the outer periphery thereof.

The formation of the folding parts 25 enables the insertion portion 20 to be comfortably worn on the second and third knuckles of the finger and also allows the thickness of the insertion portion 20 to be adjusted properly.

Figure 5:
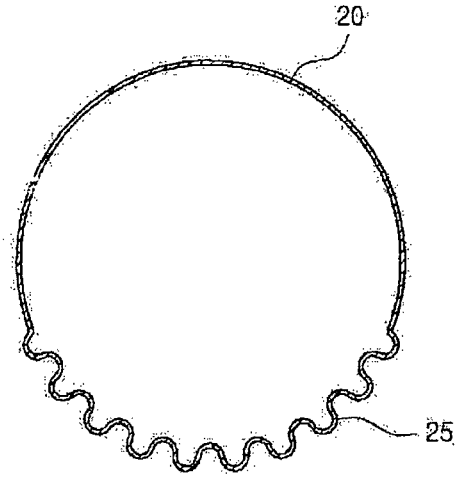
FIG. 5 is a sectional view taken along the line B-B' of an insertion portion in the sanitary finger cap according to the first embodiment of the present invention.

Further, as shown in FIG. 5, the space portions formed between the adjacent folding parts 25 allow the ventilation performance of the sanitary finger cap to be raised, thereby reducing the generation of moisture caused by the sweat inside the sanitary finger cap and easily stripping off the sanitary finger cap after the use.

The insertion portion 20 has an edge part 23 formed along the end periphery thereof.

The edge part 23 is formed to be thicker than the entire surface of the insertion portion 20 and serves to rigidly finish the end portion of one side opened outside of the insertion portion 20. Further, the edge part 23 serves as a handle when the sanitary finger cap is worn on the finger and also helps the end portion of the sanitary finger cap to be brought into close contact with the knuckle of the finger.

Moreover, the edge part 23 is rolled up outwardly to adjust the entire length of the sanitary finger cap, and if the edge part 23 is rolled up, the internal size of the insertion portion 23 becomes reduced, which is useful for people who have short fingers or for women or children having thin fingers.

The edge part 23 has a round shape, which is convenient to roll up, and also, it can be formed in a band shape having a predetermined width.

The grasping portion 10 is connected to one side of the insertion portion 20 as a unitary body, in a shape of a general corn or pyramid in such a manner as to become small in its internal size as it goes toward a distal end thereof, and the grasping portion 10 can be formed to be streamlined in accordance with the shape of the finger.

When the sanitary finger cap is worn on the finger, also, the grasping portion 10 has an internal space portion for accommodating a first knuckle in the end portion of the finger or the second knuckle of the finger thereinto, and becomes brought into direct contact with food when the food is grasped thereon.

Figure 4:
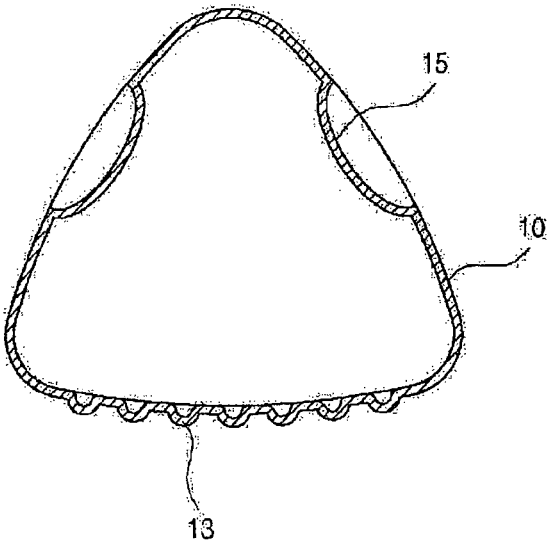
FIG. 4 is a sectional view taken along the line A-A' of a grasping portion in the sanitary finger cap according to the first embodiment of the present invention.

According to the first embodiment of the present invention, the grasping portion 10 has a generally trigonal pyramid, and as shown in FIG. 4, the grasping portion 10 has a generally trigonal section.

Like this, the grasping portion 10 has the trigonal section, and empty space portions are formed at both sides of the grasping portion 10 and at a top side of the grasping portion 10 when the sanitary finger cap is worn on the finger, thereby improving the ventilation performance of the sanitary finger cap. Further, the sides of the trigonal pyramid serve to press both ends of the top portion of the finger, thereby improving the feeling of wearing.

Further, the grasping portion 10 has protrusions 13 and fixing grooves 15 formed on the outer surface thereof.

As shown in FIG. 3, the protrusions 13 are formed protrudedly from a partial or entire surface of the grasping portion 10, such that when food is grasped, the food does not slip on the grasping portion 10 and the state of grasping the food is stably maintained.

As the protrusions 13 are formed, the underside of the grasping portion 10 becomes thicker than the other surface thereof, such that when hot food is grasped, the hot temperature of the food is not transferred just to the skin of the finger.

According to the first embodiment of the present invention, the protrusions 13 are formed in a circular shape on the underside of the grasping portion 10, but they can be formed in various shapes like combs, straight lines and so on.

The fixing grooves 15 are formed to be depressed toward the inside of the sanitary finger cap on one side surface of the outer periphery of the grasping portion 10 and are adapted to be brought into close contact with the outer periphery of the finger, thereby improving the feeling of wearing of the sanitary finger cap.

In more detail, since the thicknesses of the fingers are different in accordance with males and females, adults and children, or individuals, the formation of the fixing grooves 15 enables the sanitary finger cap to be adjusted in accordance with the thicknesses of fingers, thereby improving the feeling of wearing of the sanitary finger cap.

That is, as shown in FIG. 4, the grasping portion 10 has the generally trigonal section and forms the protrusions 13 on the underside thereof and the fixing grooves 15 on both sides thereof in such a manner as to be depressed toward the inside of the sanitary finger cap, such that when the sanitary finger cap is worn on the finger, the grasping portion 10 is pressedly brought into close contact with both ends of the top portion of the finger, thereby allowing the sanitary finger cap to be stably worn on the finger.

The shapes of the fixing grooves 15 are not limited to that according to the first embodiment of the present invention, and therefore, they can be freely changed in accordance with the shape of the grasping portion 10.

Figure 6:
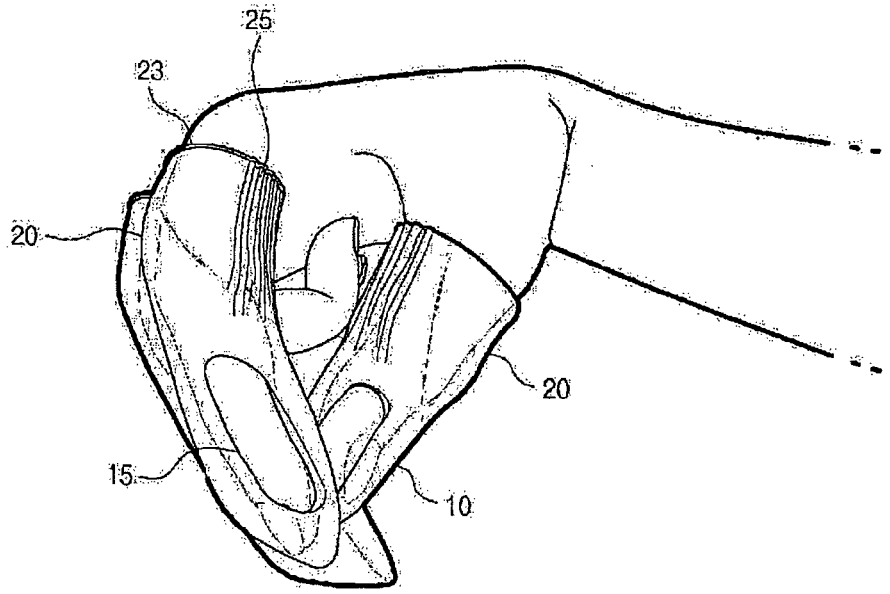
FIG. 6 is a perspective view showing the usage of the sanitary finger cap according to the first embodiment of the present invention.

FIG. 6 is a perspective view showing the usage of the sanitary finger cap according to the first embodiment of the present invention, wherein the sanitary finger cap is worn on each of the thumb, the index finger and the middle finger which are mostly used when food is grasped.

Since the thumb is relatively thicker and shorter than the other fingers, the sanitary finger cap to be worn on the thumb desirably has relatively shorter entire length and larger sectional size than the sanitary finger caps to be worn on the other fingers.

Of course, it is possible to wear the sanitary finger cap on all of fingers of the hand, respectively, but desirably, the sanitary finger cap is worn just on each of the thumb and the index finger used mostly for grasping food. So as to grasp food in a more stable manner, most preferably, the sanitary finger cap is worn on each of the thumb, the index finger and the middle finger according to the first embodiment of the present invention.

Figure 7:
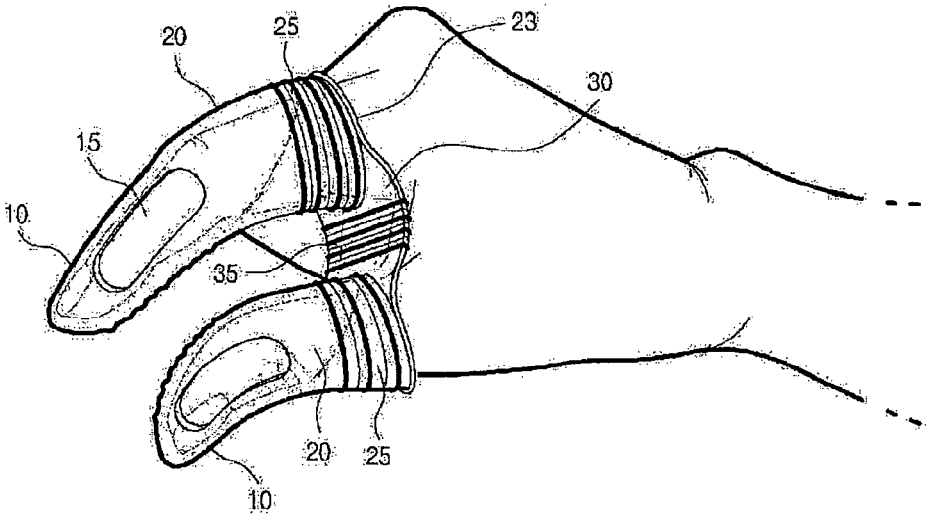
FIG. 7 is a perspective view showing a sanitary finger cap according to a second embodiment of the present invention.

FIG. 7 is a perspective view showing a sanitary finger cap according to a second embodiment of the present invention, wherein the sanitary finger cap further includes a connection portion 30.

As shown, the connection portion 30 is formed by connecting a portion of the end periphery of the insertion portion 20 of the sanitary finger cap worn on the thumb with a portion of the end periphery of the insertion portion 20 of the sanitary finger cap worn on the index finger, as a unitary body to each other.

The connection portion 30 serves to prevent the sanitary finger caps from being lost and to prevent them from being easily stripped off.

Also, the connection portion 30 is formed of a string, but if it is formed of a band having a given width, it covers the skin between the fingers or a portion of the palm of the hand adjacent to the fingers when the sanitary finger caps are worn on the fingers, such that when hot food is grasped, food or oil does not stain the palm of the hand.

Further, the connection portion 30 has connection folding parts 35 formed thereon so as to allow the activities of the fingers to be easy when the sanitary finger caps are worn on the fingers.

The connection folding parts 35 serve to raise the expansion and contraction of the connection portion 30 between the fingers on which the sanitary finger caps are worn, especially the thumb and the index finger. According to the second embodiment of the present invention, the connection folding parts 35 are formed of a bellows.

Figure 8:
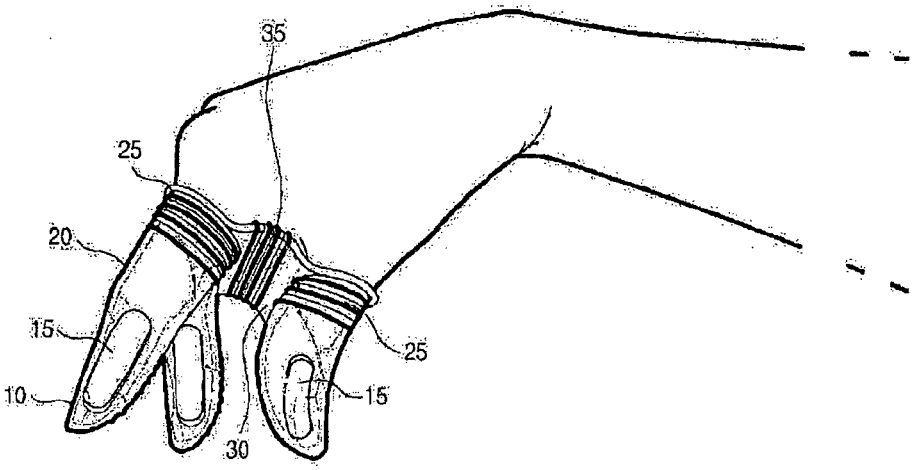
FIG. 8 is a perspective view showing a sanitary finger cap according to a third embodiment of the present invention.

FIG. 8 is a perspective view showing a sanitary finger cap according to a third embodiment of the present invention, wherein the sanitary finger cap further includes a connection portion 30 adapted to connect portions of the end peripheries of the insertion portions 20 of the sanitary finger caps worn on the thumb, the index finger and the middle finger with each other as a unitary body.

If the connection portion 30 is formed, a portion of the edge part 23 abutting with the connection portion 30 is removed naturally, and alternatively, the entire portion of the edge part 23 is removed.

The edge part 23 serves as a handle when the sanitary finger cap is put on or taken off, and therefore, it is preferable that the edge part 23 still remains even though it exists partially.

Further, the folding parts 25 on the sanitary finger cap according to the first embodiment of the present invention are formed in a direction of length of the finger on the underside of the insertion portion 20 of the sanitary finger cap, but the folding parts 25 on the sanitary finger cap according to the second and third embodiments of the present invention are formed in a direction of the circumference of the finger along the upper periphery of the insertion portion 20 of the sanitary finger cap.

Figure 9:
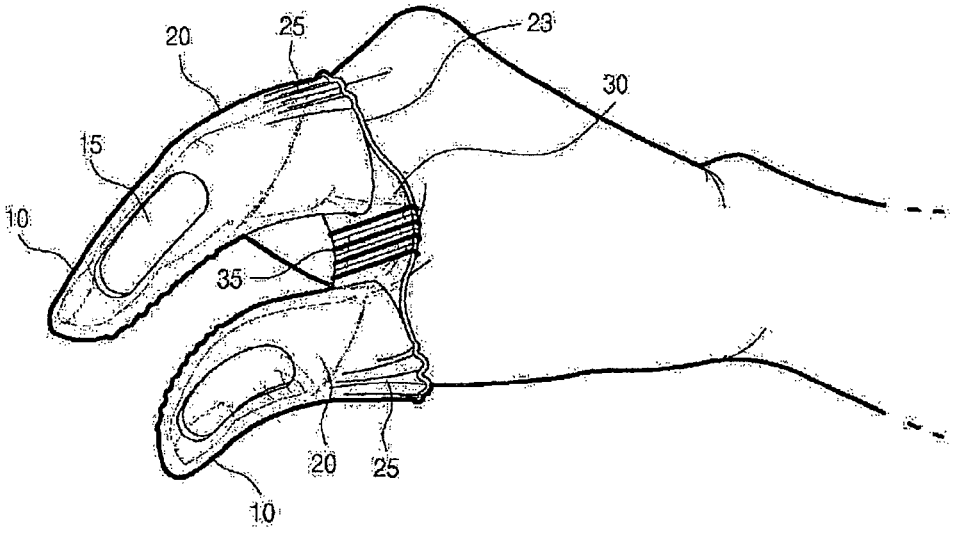
FIG. 9 is a perspective view showing a sanitary finger cap according to a fourth embodiment of the present invention.

FIG. 9 is a perspective view showing a sanitary finger cap according to a fourth embodiment of the present invention, wherein the folding parts 25 are formed in a direction of length of the finger on a portion of the top end periphery of the insertion portion 20 of the sanitary finger cap.

Of course, it is possible to form the folding parts 25 on the insertion portion 20, without giving no influence on the connection portion 30, but if the folding parts 25 are formed on the underside of the insertion portion 20, the connection portion 30 is brought into close contact with the skin of the palm of the hand to cause the ventilation performance to be lowered. Accordingly, if the connection portion 30 is formed, the folding parts 25 are preferably formed on the top periphery of the insertion portion 20 of the sanitary finger cap.

Figure 10:
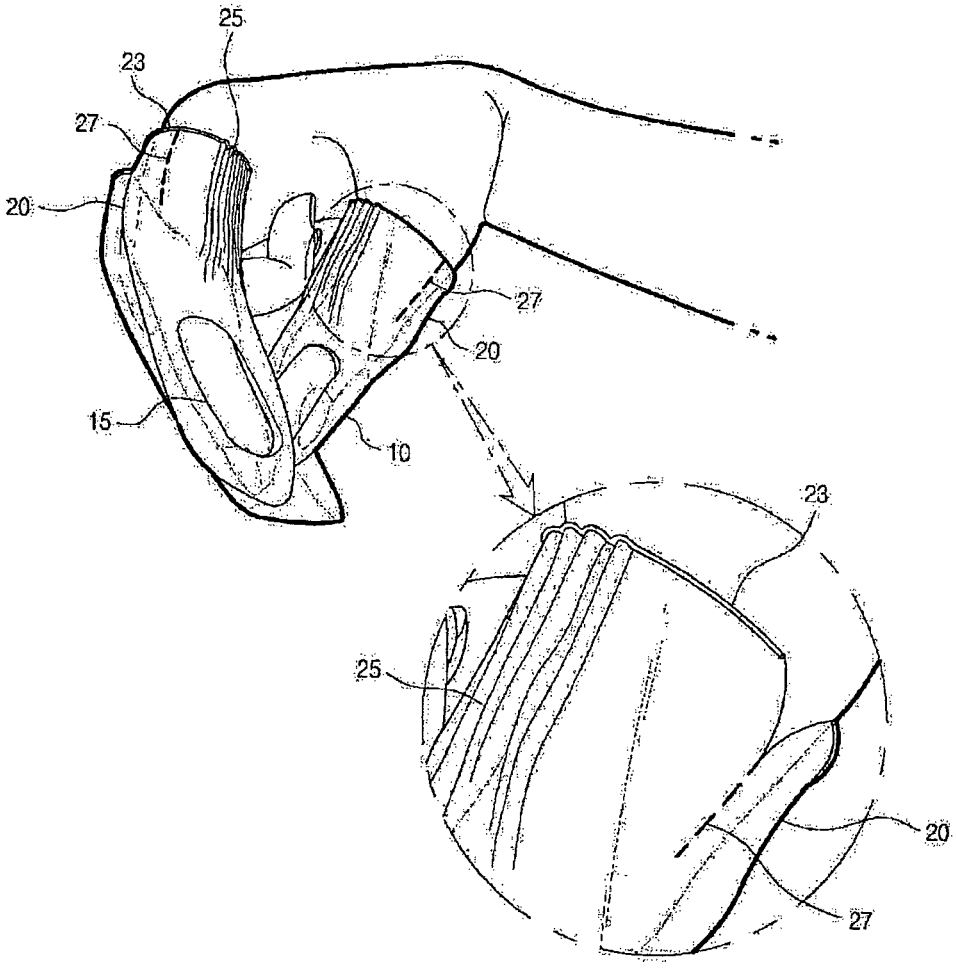
FIG. 10 is a perspective view showing a sanitary finger cap according to a fifth embodiment of the present invention.

FIG. 10 is a perspective view showing a sanitary finger cap according to a fifth embodiment of the present invention, wherein the sanitary finger cap is the same configuration as that in the first embodiment of the present invention, except that the insertion portion 20 further includes an incision part 27 formed at one side thereof.

Even though the sanitary finger cap is made in consideration of the thicknesses of fingers of adults and children and the thicknesses of fingers of adult males and females, it is sometimes hard to insert a relatively thicker finger than a finger having an average thickness into the insertion portion 20 of the sanitary finger cap.

According to the fifth embodiment of the present invention, in this case, the incision part 27 is formed in a shape of a dotted line in a direction of length of the sanitary finger cap at one side of the insertion portion 20, such that as one side of the insertion portion 20 becomes cut off, the end portion of the finger can be inserted well into the grasping portion 10.

According to the fifth embodiment of the present invention, the incision part 27 is formed in a shape of a dotted line, but it can be formed plurally in various shapes.

When the sanitary finger cap is worn on the finger, the food can be grasped in a sanitary state without staining the finger, and also, the food does not remain on the hand, so that the hand can be easily washed after taking the food and food odors do not stay on the hand.

As set forth in the foregoing, the sanitary finger cap according to the preferred embodiments of the present invention has the following advantages:

Firstly, since the sanitary finger cap having the insertion portion and the grasping portion connected as a unitary body with each other is worn on the finger, the food can be grasped in a sanitary state without staining the finger, and also, the food does not remain on the hand, such that the hand can be easily washed after taking the food, and food odors do not stay on the hand.

Secondly, since the protrusions are formed on the underside of the grasping portion, the food can be stably maintained in the grasped state, without any slippage on the grasping portion.

Thirdly, since the protrusions are formed on the underside of the grasping portion, a hot temperature generated from hot food is not directly transferred to the skin of a wearer's hand when the hot food is grasped.

Fourthly, since the fixing grooves are formed on the top surface of the grasping portion, the sanitary finger cap can be brought into close contact with a top of the finger, thereby being adjustable in accordance with the thickness of the finger.

Fifthly, the folding parts are formed on a partial or entire surface of the insertion portion, thereby improving the feeling of wearing of the sanitary finger cap.

Sixthly, the folding parts are formed on a partial or entire surface of the insertion portion, thereby improving a ventilation performance of the sanitary finger cap, preventing moisture from being formed in the interior of the sanitary finger cap, and easily stripping the sanitary finger cap off after the use.

Seventhly, since the edge part is formed along the end periphery thereof in such a manner as to be rolled up, the length of the sanitary finger cap and the peripheral size of the insertion portion can be all adjusted.

Eighthly, the connection portion is formed to connect the end portions of the insertion portions of two or more sanitary finger caps, thereby improving the feeling of wearing of the sanitary finger cap and preventing the respective sanitary finger caps from being lost.

Ninthly, since the connection portion is formed to connect the end portions of the insertion portions of a plurality of sanitary finger caps, the connection portion is brought into close contact with the skin between the fingers or a portion of the palm of the hand when the sanitary finger caps are worn on the fingers, thereby preventing the food from staining the palm of the hand.

Lastly, the connection folding parts are formed on the connection portion connecting the plurality of sanitary finger caps so as to adjust the entire length of the connection portion, thereby allowing the activities of the fingers to be easy when the sanitary finger caps are worn on the fingers.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A sanitary glove comprising at least one sanitary finger cap, the sanitary finger cap including:

an insertion portion having a cylindrical shape and occupying between a half and one third of a total length of the sanitary finger cap from an proximal end thereof; and a grasping portion being other portion of the sanitary cap than the insertion portion and connected to the insertion portion as a unitary body, the grasping portion being in a shape of a hollow triangular pyramid with rounded edges, wherein the insertion portion includes:

a plurality of folding parts formed in a longitudinal direction on a partial or an entire surface of an outer periphery of the insertion portion to enhance a ventilation performance, the folding parts being formed only in the insertion portion without being formed in the grasping portion;

a round or band-shaped edge part surrounding the proximal end of the insertion portion in all direction; and an incision part formed in a shape of a dotted line at the insertion portion such that the incision part is not cut off in a normal condition but becomes cut off when a finger having a greater diameter than that of the insertion portion is inserted thereto, and wherein the grasping portion includes:

a plurality of protrusions formed on one face of the grasping portion; and one concave part formed in a longitudinal direction on each of the other two faces of the grasping portion and having a concave surface bulging toward an inside of the grasping portion, the concave part being formed only in the grasping portion without being formed in the insertion portion and having a length greater than a width thereof, wherein the grasping part has a uniform thickness in all area thereof including the concave part and the protrusions.

2. The sanitary glove according to claim 1, comprising two or more sanitary finger caps.

3. The sanitary glove according to claim 2, further comprising a connection portion configured to connect the proximal ends of the insertion portions of the two or more sanitary finger caps with one another.

4. The sanitary glove according to claim 3, wherein the connection portion includes connection folding parts configured to increase expansion and contraction of the connection portion.

* * * * *